US005723938A

United States Patent [19]

Kato et al.

[11] Patent Number: 5,723,938

[45] Date of Patent: Mar. 3, 1998

[54] CRT WITH ASYMMETRIC ELECTRODE GEOMETRY IN INLINE DIRECTION WITH RESPECT TO SIDE BEAM APERTURES IN FIRST GRID ELECTRODE

[75] Inventors: Shinichi Kato; Tutomu Tojyo, both of Mobara, Japan

[73] Assignee: Hitachi, Ltd., Tokyo, Japan

[21] Appl. No.: 598,702

[22] Filed: Feb. 8, 1996

[30] Foreign Application Priority Data

Feb. 13, 1995 [JP] Japan ..... 7-024233

[51] Int. Cl.[6] ..... H01J 29/46

[52] U.S. Cl. ..... 313/412; 313/414

[58] Field of Search ..... 313/412, 413, 313/414, 425, 426, 428, 447, 460

[56] References Cited

U.S. PATENT DOCUMENTS

| | | | |
|---|---|---|---|
| 4,366,414 | 12/1982 | Hatayama et al. | 313/409 |
| 4,520,292 | 5/1985 | Van Hekken et al. | 313/414 |
| 4,628,224 | 12/1986 | Collins et al. | 313/414 |
| 4,891,549 | 1/1990 | Kniesser et al. | 313/414 |
| 5,128,586 | 7/1992 | Ashizaki et al. | 313/414 |
| 5,483,128 | 1/1996 | Chen | 313/414 |

*Primary Examiner*—Sandra L. O'Shea
*Assistant Examiner*—Vip Patel
*Attorney, Agent, or Firm*—Antonelli, Terry, Stout & Kraus, LLP

[57] ABSTRACT

In a color cathode ray tube having an inline electron gun, an electrode geometry asymmetric in the inline direction is provided on the two side beam apertures in the first grid electrode for the two side beams on the side facing the cathode such that as the electron beam current through the side beam apertures decreases, the degree of an asymmetry in the inline direction in a distribution of an electric field between the side beam apertures and the cathodes increases.

20 Claims, 11 Drawing Sheets

CRT WITH ASYMMETRIC ELECTRODE GEOMETRY IN INLINE DIRECTION WITH RESPECT TO SIDE BEAM APERTURES IN FIRST GRID ELECTRODE

BACKGROUND OF THE INVENTION

The present invention relates to a color cathode ray tube used as a video display means in a TV receiver or a monitor means in an information device terminal such as a personal computer and particularly to a color cathode ray tube equipped with an electron gun having a constitution for preventing a convergence error due to a change in the current of an electron beam.

A color cathode ray tube used as a video display means in a TV receiver or a monitor means in an information device terminal such as a personal computer includes an evacuated envelope comprising a faceplate portion, a neck portion, and a funnel portion connecting them, a multi-apertured color selection electrode suspended in the evacuated envelope and disposed a short distance from the color phosphor screen formed on the inner surface of the faceplate portion, an inline electron gun housed in the neck portion for emitting and directing three electron beams so as to converge at a point on the color phosphor screen, and a deflection device mounted in the neighborhood of a junction of the neck portion and the funnel portion of the evacuated envelope for generating a magnetic field for deflecting the three electron beams emitted from the electron gun in the two horizontal and vertical directions.

The inline electron gun housed in the neck portion has a plurality of electrodes such as a cathode, a control grid electrode, a focus grid electrode, and an accelerating grid electrode and directs three electron beams having a predetermined sectional shape and predetermined energy provided by the focus grid electrode and the accelerating grid electrode toward the color phosphor screen after modulating the amount of an electron beam current from the cathode by a signal applied on the cathode or the control grid electrode.

The three emitted electron beams are deflected by the horizontal and vertical deflecting magnetic fields generated by the deflection device mounted in the neighborhood of a junction of the neck portion and the funnel portion and impinge on the respective intended phosphors via the multi-apertured color selection electrode, a so-called shadow mask so as to reproduce a color image.

FIG. 10 is a schematic cross sectional view illustrating the structure of a color cathode ray tube. Reference numeral 1 indicates an evacuated envelope comprising a faceplate portion, a neck portion and a funnel portion, 2 a faceplate portion, 3 a color phosphor screen, 4 a shadow mask, or a multi-apertured color selection electrode, 5 an internal conductive coating, 6 a deflection device, 7, 8, and 9 cathodes, 10 a first grid electrode, 30 a second grid electrode, 31 a third grid electrode, 32 a fourth grid electrode, 33 a shield cup, 35, 36, and 37 center axes, 38 and 39 center axes of the electron beam apertures of the fourth grid electrode, 40 a neck portion, and 41 a convergence correction magnet.

In the figure, the cathodes 7, 8, and 9, the first grid electrode 10, and the second grid electrode 30 constitute an electron beam generating section, a so-called triode section. The cathodes 7, 8, and 9, the first grid electrode 10, and the second grid electrode 30 are arranged in parallel with each other.

When a cathode ray tube is incorporated in a TV receiver, a ground potential is applied on the first grid electrode 10, and a fixed voltage of about 650 V is applied on the second grid electrode 30, and the electron beam amount is varied with the cathode voltage.

If the voltages applied on the cathodes 7, 8, and 9 are higher than the voltage applied on the first grid electrode 10, as the potential difference between the cathodes and the first grid electrode 10 increases, the electron beam current decreases. If the voltages applied on the cathodes 7, 8, and 9 are lower than the voltage applied on the first grid electrode 10, as the potential difference between the cathodes and the first grid electrode 10 decreases, the electron beam current increases.

In the first grid electrode 10, circular apertures (electron beam apertures) for passing electron beams from the inline cathodes 7, 8, and 9, respectively are formed and also in the second grid electrode 30, similar apertures are formed.

Electron beams are emitted from the electron beam generating section along the center axes 35, 36, and 37 arranged substantially in parallel with each other in the horizontal plane (inline plane) and enter the main lens section formed by the third grid electrode 31 and the fourth grid electrode 32.

The center axes of the apertures of the third grid electrode 31 and the shield cup 33 associated with the respective electron beams coincide with the center axes 35, 36, and 37, respectively.

The center axis of the aperture at the center of the fourth grid electrode 32 coincides with the center axis 36 (the tube axis), and the center axes 38 and 39 of the apertures on both sides are displaced slightly toward the corresponding center axes 35 and 37.

The third grid electrode 31 is supplied with a lower potential than the fourth grid electrode 32 and the fourth grid electrode 32 is at a high potential, the anode potential (Eb) equal to those of the shield cup 33 and the internal conductive coating 5.

The apertures at the centers of the third grid electrode 31 and the fourth grid electrode 32 are concentric, so that an axially symmetric main lens is formed at the center between the third grid electrode 31 and the fourth grid electrode 32 and the center electron beam is focused by the main lens and then travels straight along the tube axis.

On the other hand, the center axes of the apertures associated with the side electron beams of the third grid electrode 31 and the fourth grid electrode 32 are displaced from each other, so that non-axially-symmetric main lenses for the side electron beams are formed. Therefore, the side electron beams pass through portions displaced toward the center electron beam from the center axis of the lens in the divergent lens region of the main lens region on the side of the fourth grid electrode 32 and are given the focusing action by the main lens and the converging action toward the center electron beam direction at the same time.

The three electron beams are focused like this, respectively and converged on the shadow mask 4 so as to overlap each other at the same time. By doing this, rough static convergence can be achieved.

To reproduce a satisfactory image, it is necessary that three electron beams impinge on coincident regions on the phosphor screen of the cathode ray tube. For that purpose, the electron gun of the cathode ray tube is designed so that three electron beams are ideally converged to a point at the center of the phosphor screen when the electron beams are undeflected (static convergence, hereinafter may be referred to as convergence).

However, actually convergence errors occur due to variations in the components of the cathode ray tube and variations in the tube assembly and the external convergence correction magnet 41 is attached to the neck portion 40 for correcting for convergence errors.

FIG. 11 is a schematic cross sectional view illustrating action of a convergence correction magnet attached to the neck portion of a color cathode ray tube. Numerals 50 and 52 indicate side electron beams and 51 a center electron beam. Each same numeral as that shown in FIG. 10 corresponds to the same part.

In the figure, the convergence correction magnet 41 comprises a pair of annular magnets magnetized to form a quadrupole field and rotatable independently of each other around the neck portion.

The convergence of the three electron beams is achieved by adjusting the strength of the quadrupole magnetic field indicated by arrows, with the individual rotational movement of a pair of annular magnets constituting the convergence correction magnet 41 relative to each other in order to move the side electron beams 50, 52 horizontally toward the center electron beam 51.

The prior art relating to this kind of color cathode ray tube is disclosed, for example, in Japanese Patent Application Laid-Open 59-215640 and convergence adjustment is described in, for example, Chapter 8, "Picture tubes and peripheral circuit thereof" of "NHK Color TV Textbook (Vol. 1)" by Nippon Hoso Kyokai (October, 1977) in detail.

SUMMARY OF THE INVENTION

The following problems arise due to physical properties of an electron beam in the conventional color cathode ray tube.

Electrons repel each other because they have electric charges. This prevents three electron beams from converging at a point. The convergence adjustment cancels this repulsion, too.

The convergence action is generated, as mentioned above, by eccentricity between the electrodes constituting the main lens for the side electron beams and convergence of the electron beams is finely adjusted by the convergence adjustment magnet at a certain electron beam current.

The convergence adjustment action by these mechanisms is fixed even if electron beams current increases. The repulsion between electron beams increases as the electron beam current increases.

FIGS. 12A to 12C are schematic diagrams illustrating convergence of three electron beams. If the electron beams 50, 51, and 52 emitted from the cathodes 7, 8, and 9 are initially converged at a small current as shown in FIG. 12A and the current of the electron beams is subsequently increased, three electron beams underconverge, that is, the position where the three electron beams 50, 51, and 52 converge shifts beyond the phosphor screen 3, as shown in FIG. 12B. The convergence error on the phosphor screen 3 is indicated by d.

If, on the contrary, the three electron beams 50, 51, and 52 are initially converged at a large current as shown in FIG. 12A and the current of the electron beams is subsequently decreased, the three electron beams overconverge, that is, the convergence position comes before the phosphor screen 3, as indicated by dashed lines in FIG. 12C.

As mentioned above, in the prior art, a problem arises that the misconvergence occurs depending on the electron beam current and the resolution of a reproduced image is degraded.

An object of the present invention is to solve the problems of the prior arts mentioned above and to provide a color cathode ray tube of high resolution and high picture quality by eliminating the dependence of a convergence error on electron beam current.

The above object can be accomplished by configuring the shape of two side beam aperture regions in the first grid electrode facing cathodes so as to produce a horizontally asymmetric electric field distribution in the vicinity of the side beam apertures, such that at a small electron beam current a degree of a horizontal asymmetry in the electric field distribution is large and the horizontal asymmetry acts on the side beams to underconverge them, and with increasing electron beam current a degree of a horizontal asymmetry in the electric field and the effects of the horizontal asymmetry on the electron beams decrease and overconverge the electron beams as indicated by solid lines in FIG. 12C.

According to the present invention, a color cathode ray tube including an evacuated envelope having a faceplate portion, a neck portion, and a funnel portion connecting them, a multi-apertured color selection electrode suspended in the evacuated envelope and disposed a short distance from the color phosphor screen formed on the inner surface of the faceplate portion, an inline electron gun housed in the neck portion for emitting and directing three electron beams so as to converge on the color phosphor screen, and a deflection device mounted in the neighborhood of a junction of the neck portion and the funnel portion of the evacuated envelope for generating a magnetic field for deflecting the three electron beams emitted from the electron gun in the two horizontal and vertical directions is structured so that the electron gun has three inline cathodes and a plurality of grid electrodes arranged along the tube axis toward the color phosphor screen from the cathodes and a horizontal geometrical asymmetry is provided on the surface of the two side aperture regions on the side of the cathodes of one of the plurality of the grid electrodes facing both the side cathodes such that as the electron beam current through the electron beam apertures decreases, the degree of a horizontal asymmetry in the distribution of the electric field in the inline direction produced in the vicinity of the side beam apertures increases.

DETAILED DESCRIPTION OF THE PREFERRED EMBODIMENTS

A shift from convergence toward underconvergence due to repulsion of three electron beams caused by increase in electron beam current is offset by the action toward overconvergence due to a horizontal geometrical asymmetry in the side aperture regions in in the first grid electrode of the present invention so as to suppress a convergence error, and the three large-current electron beams impinge on the respective intended phosphors on the phosphor screen and a satisfactory image is reproduced.

Namely, the horizontal geometrical asymmetry of the present invention to be provided on the surface of the two side aperture regions on the side of the cathodes of the grid electrodes facing the cathodes acts on the side electron beams so as to increase the degree of the horizontal asymmetry in the electric field distribution at a small electron beam current through the electron beam apertures and underconverge the two beams, and so as to decrease the degree of a horizontal asymmetry in the electric field distribution in accordance with an increase in the electron beam current and consequently decrease the effect of the asymmetry and to act on the electron beams toward overconvergence so as to achieve satisfactory convergence over the whole current region.

The embodiments of the present invention will be explained in detail hereunder with reference to the accompanying drawings.

Figure 1A:
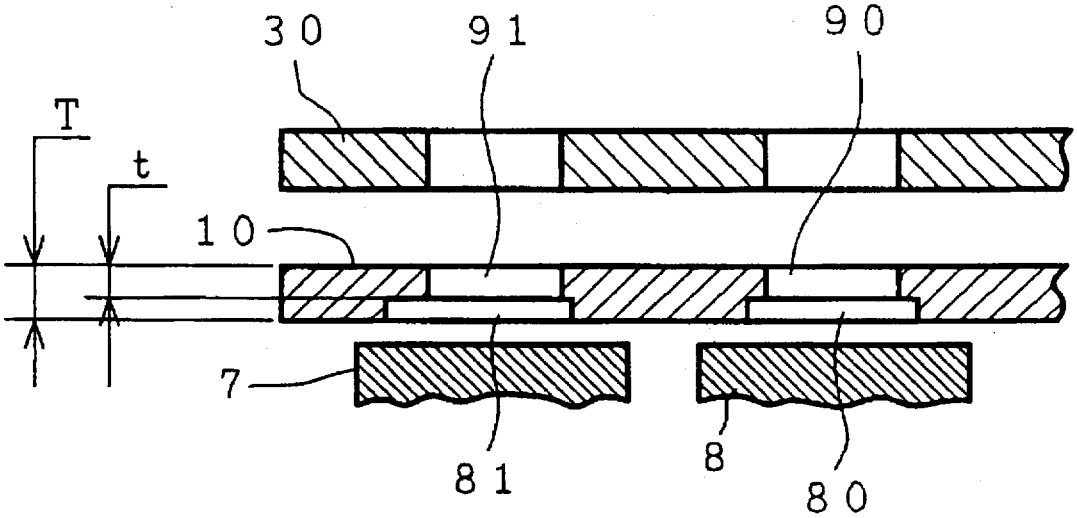
FIG. 1A is a cross sectional view of the essential section illustrating a first embodiment of a color cathode ray tube of the present invention and FIG. 1B is a partial front view of a first grid electrode in the essential section viewed from the cathode side thereof.
Figure 1B:
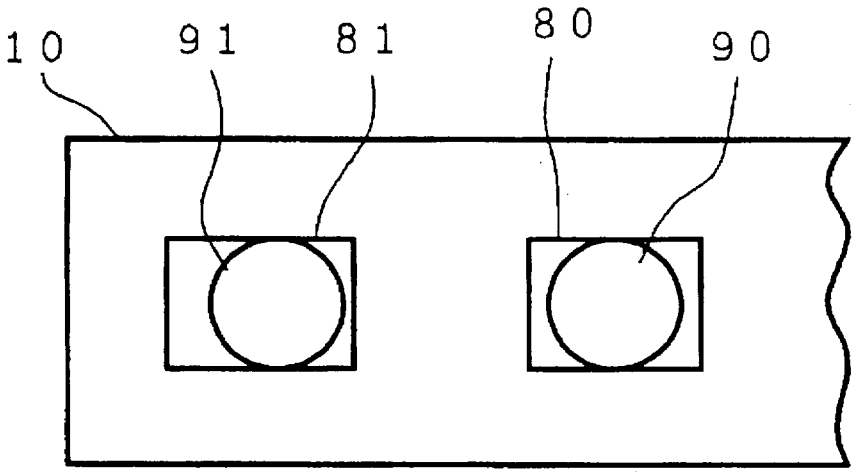

FIGS. 1A and 1B are schematic views of the essential section illustrating a first embodiment of a color cathode ray tube of the present invention. FIG. 1A is a partial cross sectional view and FIG. 1B is a partial front view of a first grid electrode in the essential section viewed from the cathode side thereof. In the figures, reference numeral 7 indicates a cathode for a side electron beam, 8 a cathode for a center electron beam, 10 a first grid electrode, 80 and 81 recesses formed in the surface of the first grid electrode on the cathode side, and 90 and 91 electron beam apertures in the first grid electrode.

In the figures, only a center electron gun and one of the side electron guns are shown. The recesses (or grooves, hereinafter may be referred to as slits) 80 and 81 having two long sides extending in the direction of arrangement of the three electron guns, that is, the inline direction of the electron guns, are superposed on the electron beam apertures 90 and 91 (circular in this embodiment) of the first grid electrode 10 on the side of the cathodes 7 and 8. The two long sides of each of the slits are almost tangent to the apertures 90 and 91. The short side of the side-beam-related slit 81 on the side of the center electron beam aperture 90 can be almost tangent to the aperture 91 at the same time.

The slit 80 for the center electron gun in the first grid electrode 10 and the aperture 90 therein are concentric with each other and the slit 81 for the side electron gun in the first grid electrode 10 is offset outwardly with respect to the aperture 91 therein in the inline direction.

It is preferable that the following inequality is satisfied;

$$0.3 < \frac{t}{T} < 0.9$$

where T is the thickness of the thick portion and t is the thickness of the thin portion in FIG. 1A.

Figure 2:
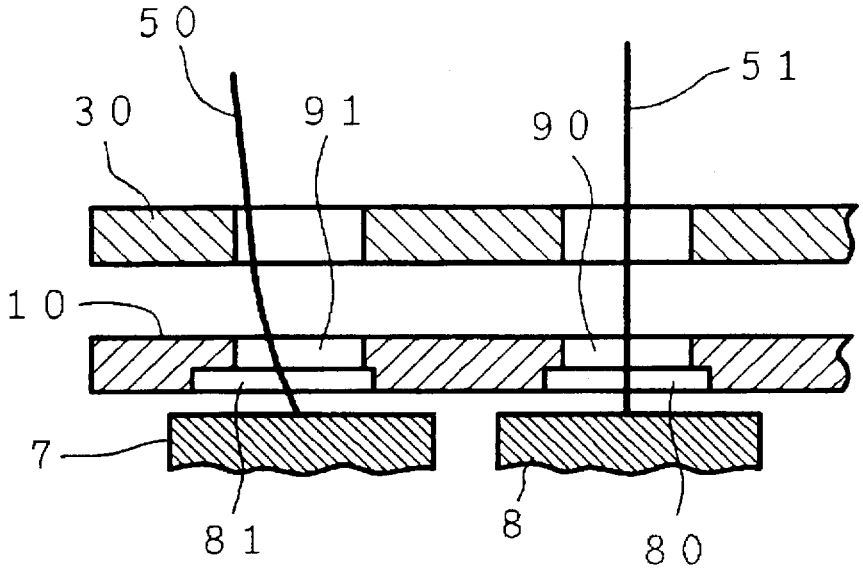
FIG. 2 is a schematic view of the essential section illustrating the operation of an electron gun having the constitution of the first embodiment of the present invention at a small electron beam current.

FIG. 2 is a schematic view of the essential section illustrating the operation of an electron gun having the constitution of the first embodiment of the present invention at a small beam current. Reference numeral 50 indicates a side electron beam and 51 a center electron beam.

In the figure, in operation of a small electron beam current, the cathode voltage is set high and the potential with respect to the first grid electrode 10 is high. As a result, the electric field between the cathode 7 of the side electron gun and the first grid electrode 10 has a horizontally asymmetric distribution due to the slit 81 offset with respect to the aperture 91 in the first grid electrode 10 and the side electron beam 50 is bent outwardly in the inline direction, that is, toward underconvergence of beams.

On the other hand, the aperture 90 in the first grid electrode 10 for the center electron gun and the associated slit 80 are concentric with each other, and the electric field generated between the cathode 8 of the center electron gun and the first grid electrode 10 is horizontally symmetrical and the center electron beam 51 travels straight independently of the voltage of the cathode 8 (that is, regardless of the electron beam current).

Figure 3:
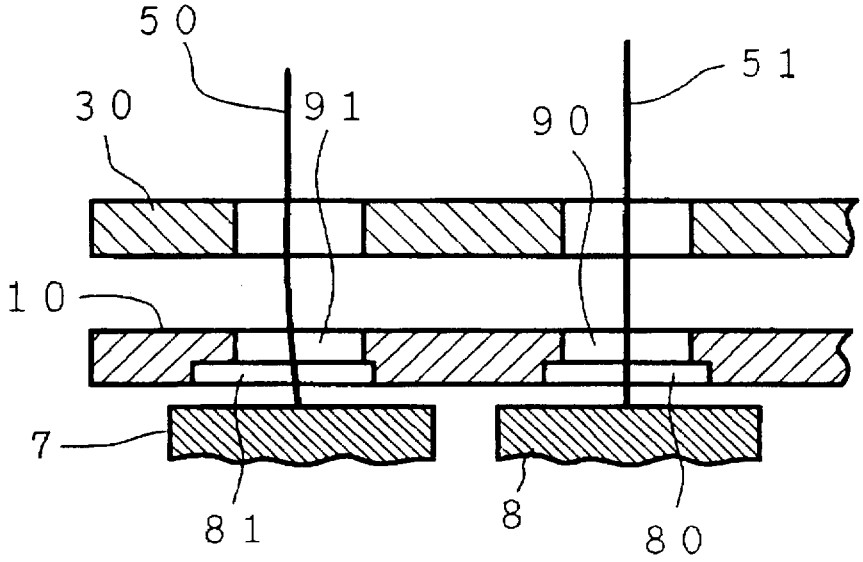
FIG. 3 is a schematic view of the essential section illustrating the operation of an electron gun having the constitution of the first embodiment of the present invention at a large electron beam current.

FIG. 3 is a schematic view of the essential section illustrating the operation of an electron gun having the constitution of the first embodiment of the present invention at a large electron beam current.

In operation of a large electron beam current, the cathode voltage is set low and the potential with respect to the first grid electrode is low. As a result, the degree of horizontal asymmetry in the distribution of the electric field generated between the cathode 7 of the side electron gun and the first grid electrode 10 is small regardless of eccentricity between the aperture 91 in the first grid electrode 10 and the slit 81. Therefore, the side electron beam 50 is directed toward the center electron beam compared with that in a small beam current operation, that is, toward overconvergence. The center electron beam 51 travels straight as in FIG. 2. By doing this, an underconvergence phenomenon caused by repulsion between the three electron beams is offset.

By using the operations shown in FIGS. 2 and 3, proper convergence of the side electron beams on the phosphor screen, can be achieved at both small and large electron beam currents.

It is preferable that the following inequality is satisfied;

$$0.3 < \frac{t}{T} < 0.9$$

where T is the thickness of the thick portion and t is the thickness of the thin portion in FIG. 1A.

Figure 4A:
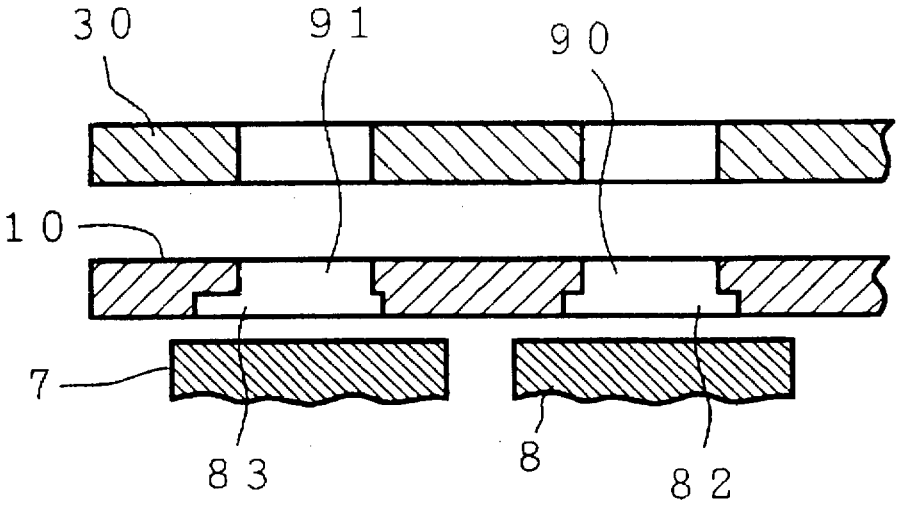
FIG. 4A is a cross sectional view of the essential section illustrating a second embodiment of a color cathode ray tube of the present invention and FIG. 4B is a partial front view of a first grid electrode in the essential section viewed from the cathode side thereof.
Figure 4B:
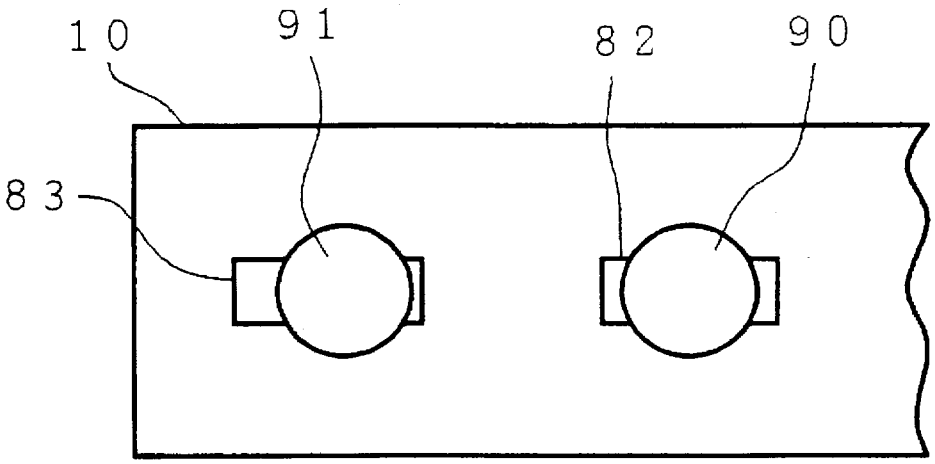

FIGS. 4A and 4B are schematic views of the essential section illustrating a second embodiment of a color cathode ray tube of the present invention. FIG. 4A is a partial cross sectional view of the essential section and FIG. 4B is a partial front view of a first grid electrode in the essential section viewed from the cathode side thereof. In this embodiment, on the center electron beam aperture 90 and side electron beam aperture 91 in the first grid electrode 10 on the side of the cathodes 8 and 9, superposed are rectangular recesses (slits) 82 and 83 which are narrower in width than the diameter of the circular electron beam apertures in the first grid electrode 10, and which have a long side in the inline direction of the apertures, respectively.

The slit 82 for the center electron gun and the electron beam aperture 90 in the first grid electrode 10 are concentric with each other and the slit 83 for the side electron gun is offset outwardly with respect to the associated aperture 91 in the inline direction of the apertures.

The actions on electron beams at small and large electron beam currents in this embodiment are the same as those shown in the first embodiment mentioned above and an underconvergence phenomenon due to repulsion between the three electron beams is offset and proper convergence can be achieved.

Figure 5A:
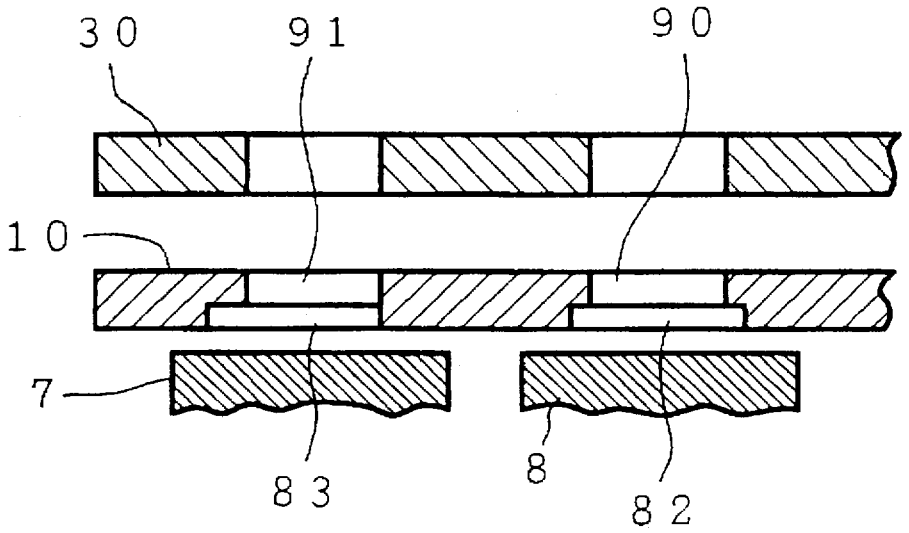
FIG. 5A is a cross sectional view of the essential section illustrating a third embodiment of a color cathode ray tube of the present invention and FIG. 5B is a partial front view of a first grid electrode in the essential section viewed from the cathode side thereof.
Figure 5B:
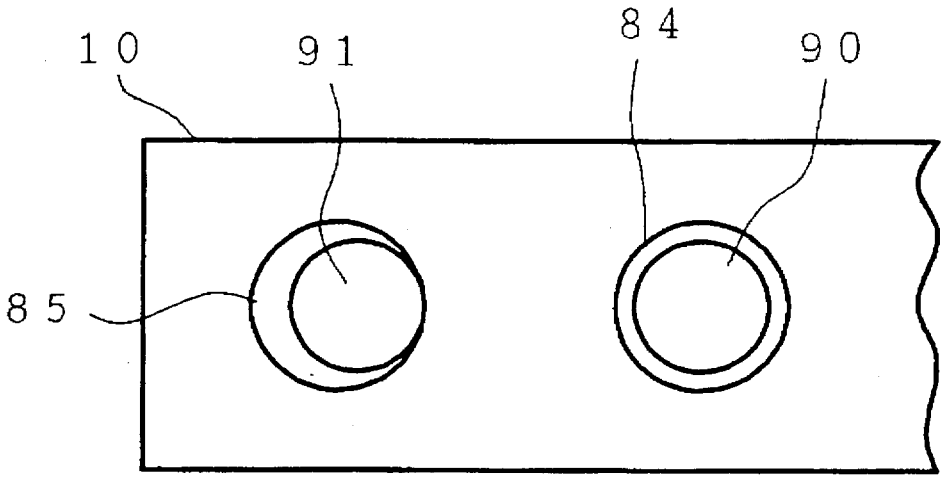

FIGS. 5A and 5B are schematic views of the essential section illustrating a third embodiment of a color cathode ray tube of the present invention. FIG. 5A is a partial cross sectional view of the essential section and FIG. 5B is a partial front view of a first grid electrode in the essential section viewed from the cathode side thereof. In this embodiment, on the circular apertures 91 and 90 in the first grid electrode 10, opposite to the cathodes 7 and 8 superposed are circular recesses 85 and 84 which are larger in diameter than the above apertures 91 and 90.

The recess 84 for the center electron gun and the associated aperture 90 are concentric with each other and the recess 85 for the side electron gun is offset outwardly with respect to the associated aperture 91 in the inline direction of the apertures.

The actions on electron beams at small and large electron beam currents in this embodiment are the same as those shown in the first and second embodiments mentioned above and an underconvergence phenomenon due to repulsion between the three electron beams is offset and proper convergence can be achieved.

Figure 6A:
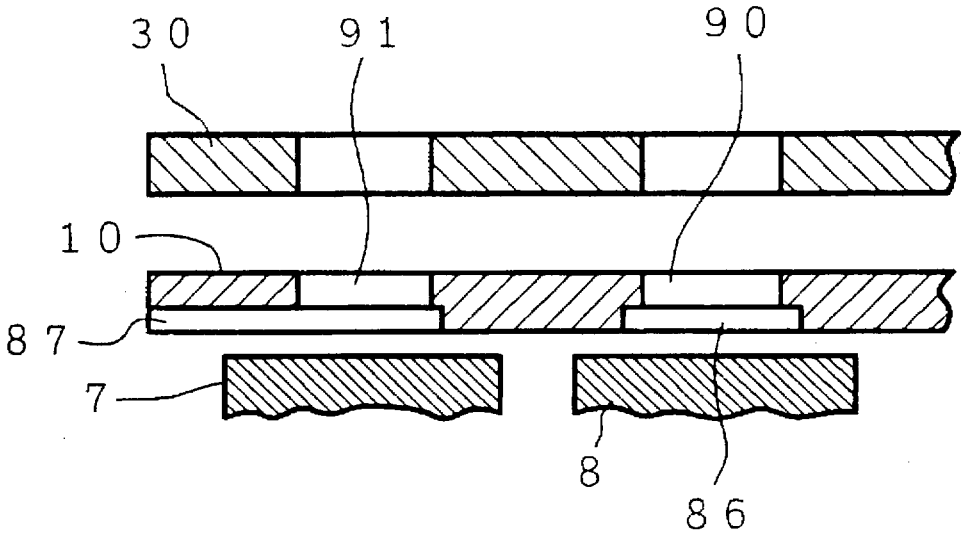
FIG. 6A is a cross sectional view of the essential section illustrating a fourth embodiment of a color cathode ray tube of the present invention and FIG. 6B is a partial front view of a first grid electrode in the essential section viewed from the cathode side thereof.
Figure 6B:
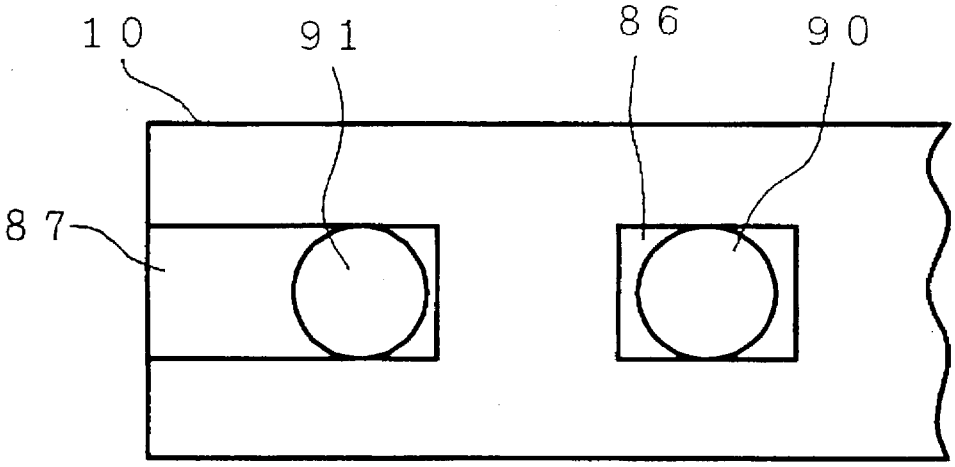

FIGS. 6A and 6B are schematic views of the essential section illustrating a fourth embodiment of a color cathode ray tube of the present invention. FIG. 6A is a partial cross sectional view of the essential section and FIG. 6B is a partial front view of a first grid electrode in the essential section viewed from the cathode side thereof.

In this embodiment, a rectangular recess 87 having two long sides tangent to the aperture 91 for the side electron gun in the first grid electrode 10 and in the inline direction of the apertures are superposed on the aperture 91 on the cathode 7 side and a rectangular recess 86 having two long sides tangent to the circular aperture 90 and in the inline direction are superposed on the circular aperture 90 on the cathode 8 side. The rectangular recess 87 for the side electron beam extends to the edge of the first grid electrode 10 in the inline direction and the wall of the outer short side of the rectangular recess 87 is removed.

The actions on electron beams at small and large electron beam currents in this embodiment are the same as those shown in each embodiment mentioned above and an underconvergence phenomenon due to repulsion between the three electron beams is offset and proper convergence can be achieved.

Figure 7A:
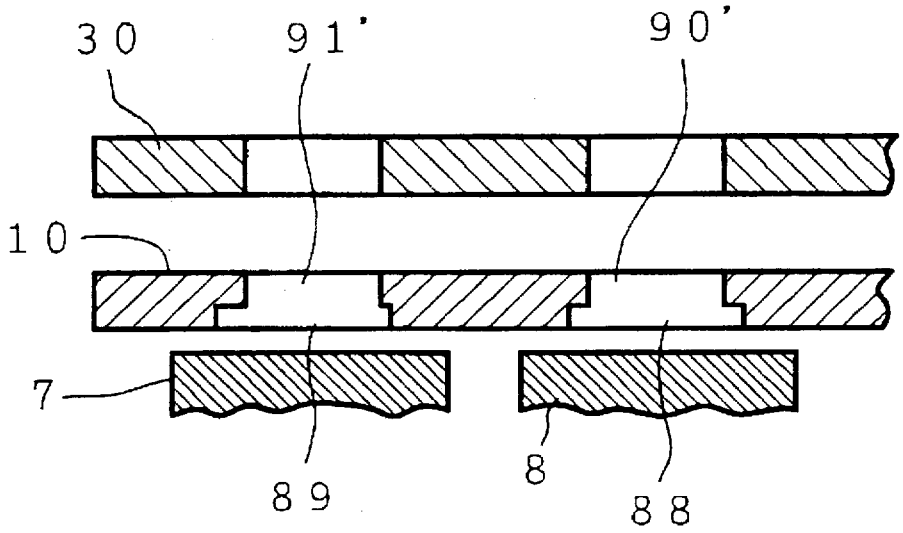
FIG. 7A is a cross sectional view of the essential section illustrating a fifth embodiment of a color cathode ray tube of the present invention and FIG. 7B is a partial front view of a first grid electrode in the essential section viewed from the cathode side thereof.
Figure 7B:
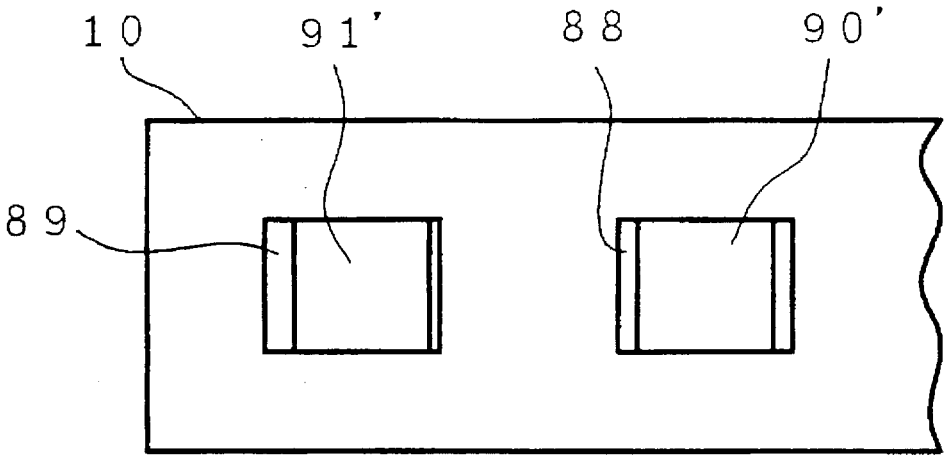

FIGS. 7A and 7B are schematic views of the essential section illustrating a fifth embodiment of a color cathode ray tube of the present invention. FIG. 7A is a partial cross sectional view of the essential section and FIG. 7B is a partial front view of a first grid electrode in the essential section viewed from the cathode side thereof. In the figure, reference numerals 90' and 91' indicate rectangular apertures (square apertures in this embodiment) in the first grid electrode 10.

On the rectangular apertures 90' and 91' in the first grid electrode 10 on the side of the cathodes 7 and 8, superposed are recesses (grooves, hereinafter may be referred to as slits) 88 and 89 having long sides in the direction of arrangement of the three electron guns, that is, the inline direction.

The two long sides of each of the slits are almost tangent to the two sides of the apertures 90' and 91' in the inline direction.

The slit 88 for the center electron gun in the first grid electrode 10 and the associated aperture 90' thereof are concentric with each other and the slit 89 for the side electron gun in the first grid electrode 10 is offset outwardly with respect to the associated aperture 90' thereof in the inline direction of the apertures.

In this embodiment, the apertures 90' and 91' in the first grid electrode 10 on the side of the cathodes are squares.

However, instead they may be rectangles having long sides in the inline direction or perpendicular to it. Furthermore, it is not necessary that the width of the slits 88 and 89 in the inline direction or perpendicular to it is the same as that of the apertures 90' and 91' and it is sufficient that the slits for the side electron guns are offset outwardly with respect to the apertures for the side electron guns in the first grid electrode 10 in the inline direction.

The action on electron beams at small and large electron beam currents in this embodiment are the same as those shown in each embodiment mentioned above and an underconvergence phenomenon due to repulsion between the three electron beams is offset and proper convergence can be achieved.

Figure 8A:
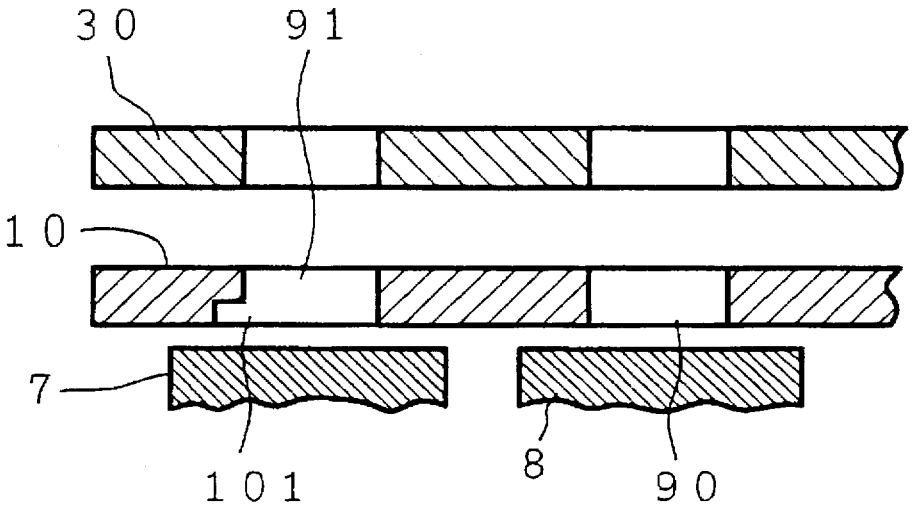
FIG. 8A is a cross sectional view of the essential section illustrating a sixth embodiment of a color cathode ray tube of the present invention and FIG. 8B is a partial front view of a first grid electrode in the essential section viewed from the cathode side thereof.
Figure 8B:
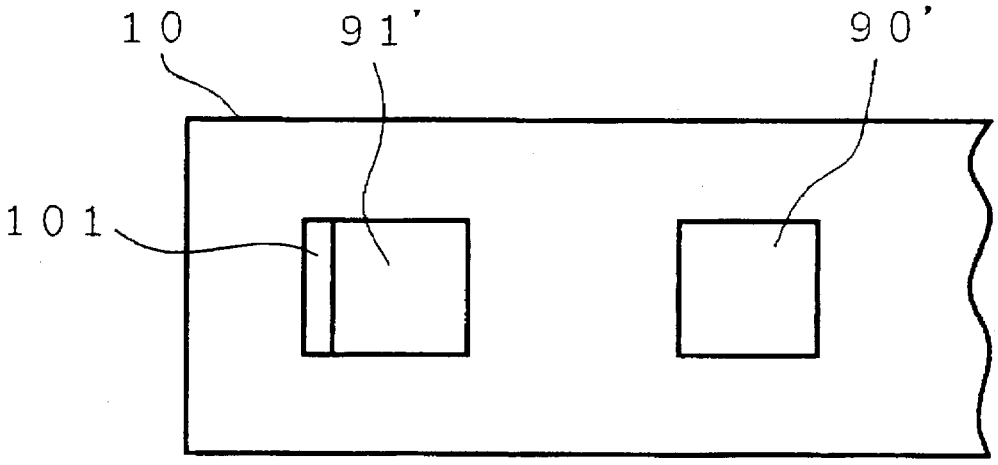

FIGS. 8A and 8B are schematic views of the essential section illustrating a sixth embodiment of a color cathode ray tube of the present invention. FIG. 8A is a partial cross sectional view of the essential section and FIG. 8B is a partial front view of a first grid electrode in the essential section viewed from the cathode side thereof. In this embodiment, the apertures 90' and 91' in the first electrode 10 on the side of the cathodes are squares and only on the aperture 91' for the side electron gun, superposed is a recess 101 which is offset outwardly in the inline direction thereof.

The recess 101 is offset outwardly with respect to the aperture 91' in the inline direction.

The actions on electron beams at small and large electron beam currents in this embodiment are the same as those shown in each embodiment mentioned above and the degree of a horizontal asymmetry in a distribution of the electric field generated between the cathode and the first grid electrode at a small electron beam current is large and the degree of a horizontal asymmetry in a distribution of the electric field at a large electron beam current decreases, so that the underconvergence due to repulsion between the electron beams is corrected and proper convergence can be achieved.

Figure 9A:
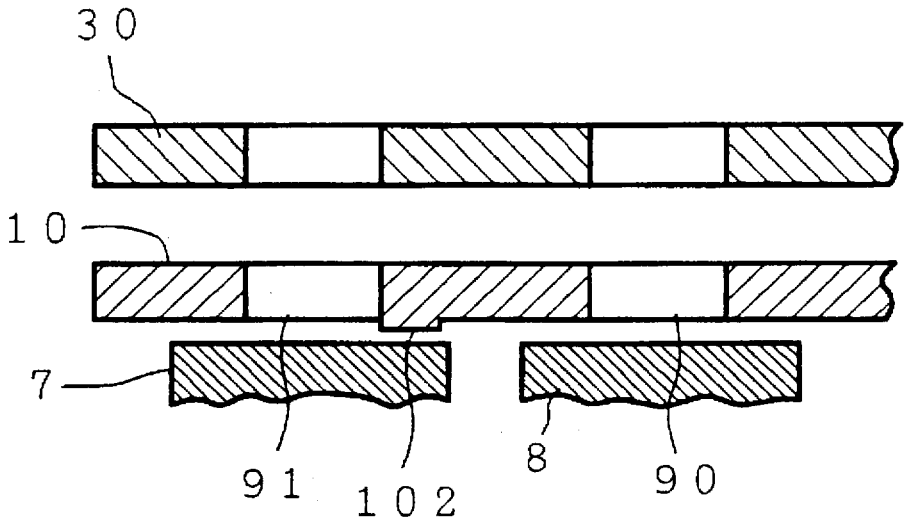
FIG. 9A is a cross sectional view of the essential section illustrating a seventh embodiment of a color cathode ray tube of the present invention and FIG. 9B is a partial front view of a first grid electrode in the essential section viewed from the cathode side thereof.
Figure 9B:
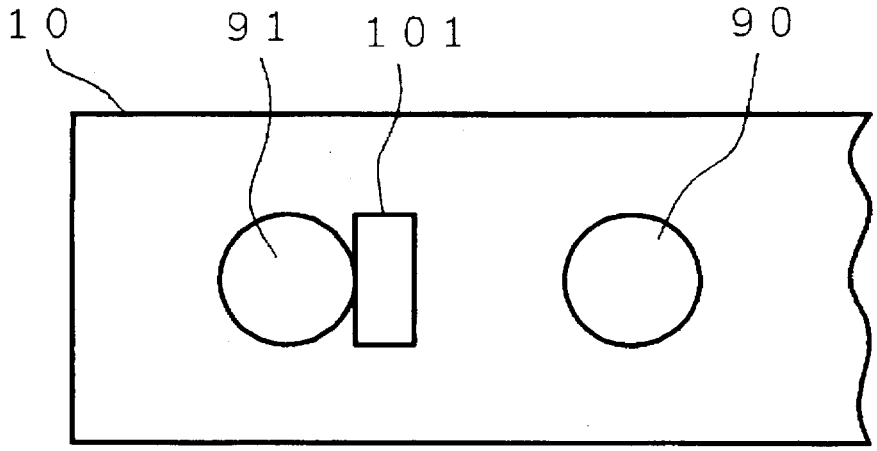
Figure 10:
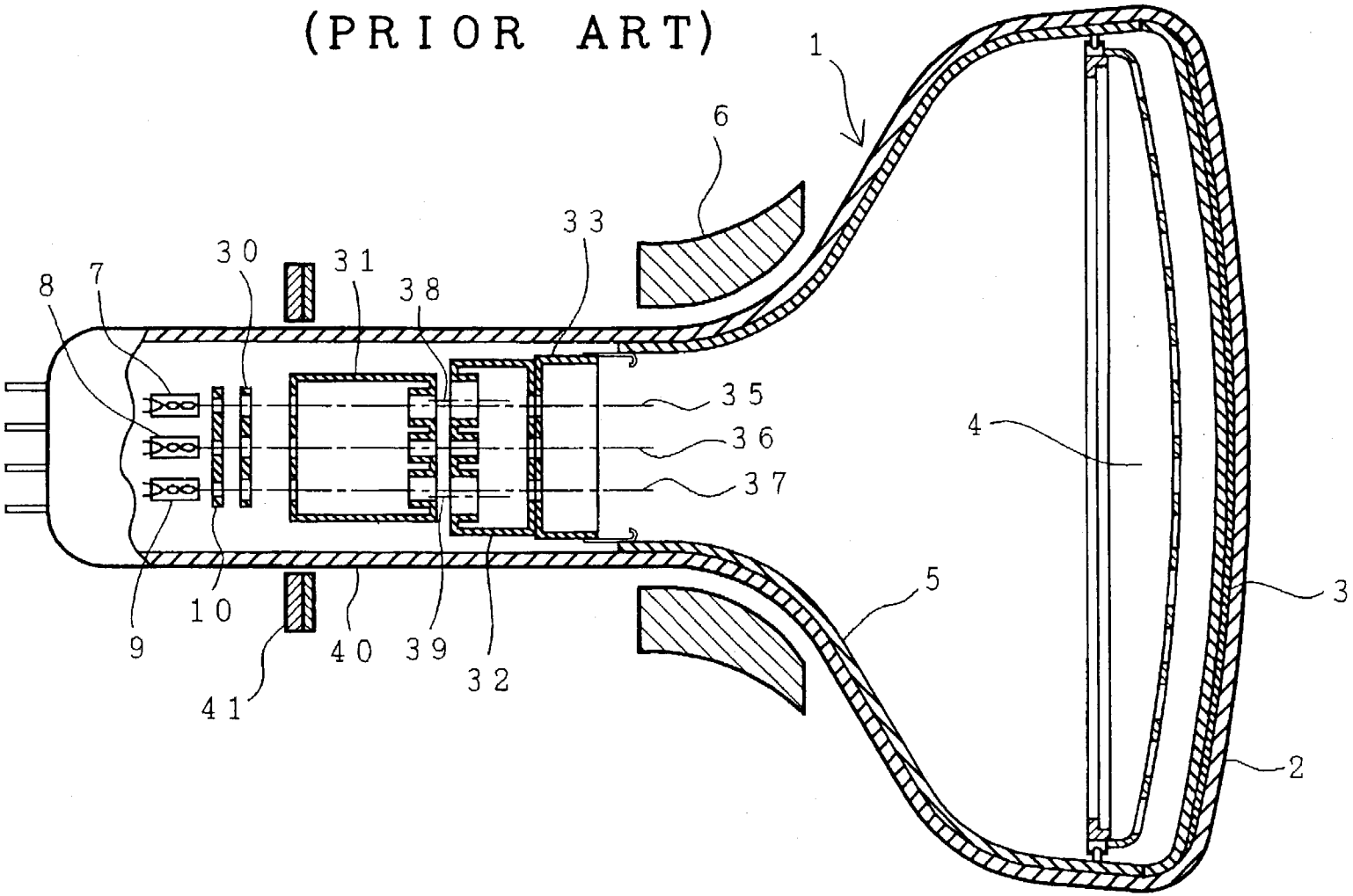
FIG. 10 (PRIOR ART)
FIG. 10 is a schematic cross sectional view illustrating the structure of a color cathode ray tube.
Figure 11:
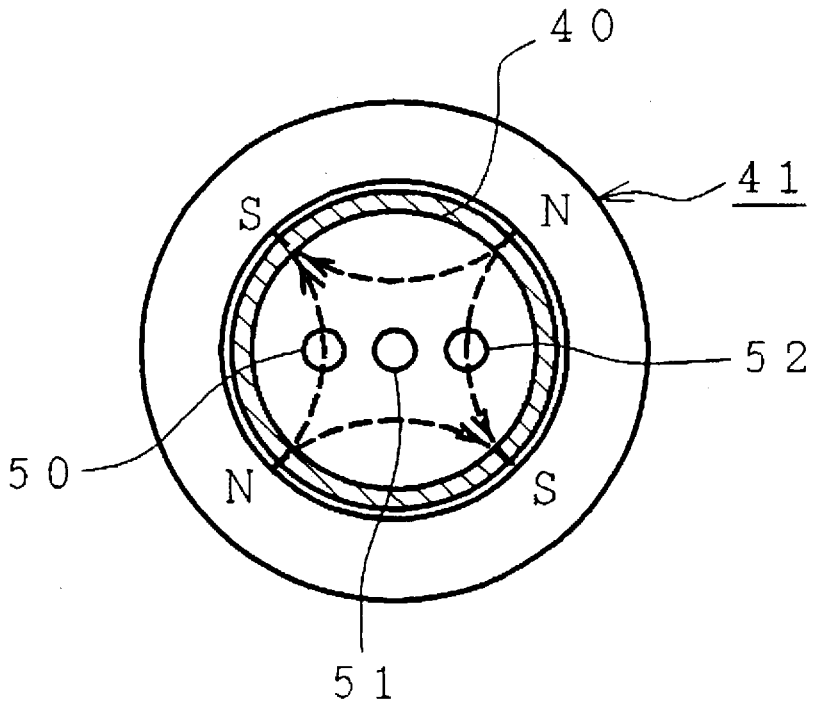
FIG. 11 (PRIOR ART)
FIG. 11 is a schematic cross sectional view illustrating the action of a convergence correction magnet attached to the neck portion of a color cathode ray tube.
Figure 12A:
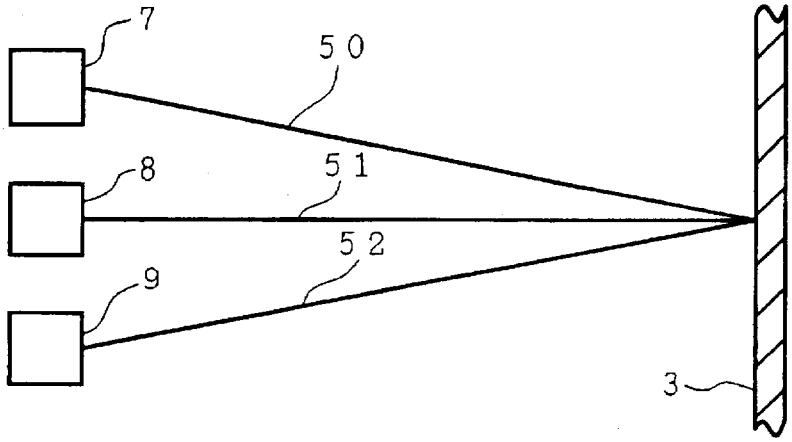
FIGS. 12A, 12B, and 12C are schematic views illustrating the just convergence, underconvergence, and overconvergence states of three electron beams respectively.
Figure 12B:
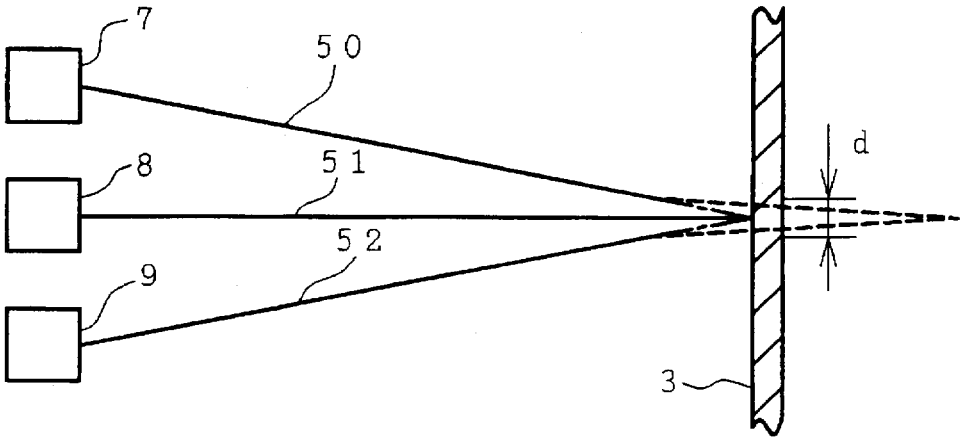
Figure 12C:
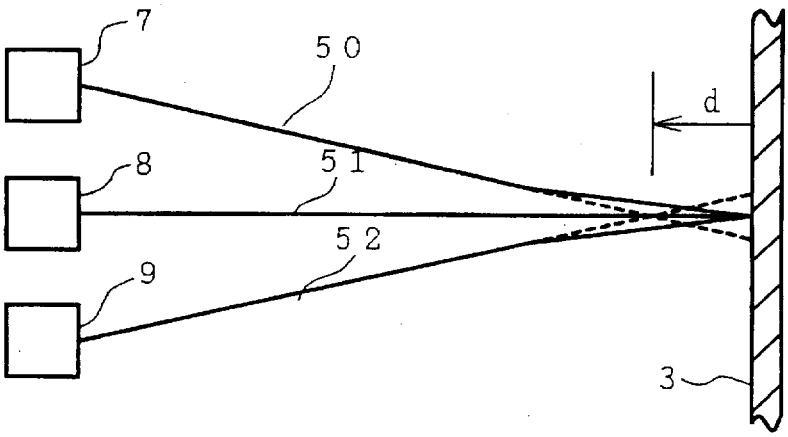

FIGS. 9A and 9B are schematic views of the essential section illustrating a seventh embodiment of a color cathode ray tube of the present invention. FIG. 9A is a partial cross sectional view of the essential section and FIG. 9B is a partial front view of a first grid electrode in the essential section viewed from the cathode side thereof. In this embodiment, the apertures 90 and 91 in the first electrode 10 are circular and a bank-shaped projection 122 is formed between the center beam aperture 90 and the side beam aperture 91 and closer to the side beam aperture 91.

The actions on electron beams at small and large electron beam currents in this embodiment are the same as those shown in each embodiment mentioned above. At a small electron beam current the degree of a horizontal asymmetry in a distribution of the electric field generated between the cathode and the first grid electrode is large, but at a large electron beam current the degree of a horizontal asymmetry in a distribution of the electric field decreases and the underconvergence due to repulsion between the electron beams is corrected and proper convergence can be achieved.

The present invention is not limited to each embodiment explained above. An asymmetrical electrode geometry suffices wherein the degree of a horizontal asymmetry in a distribution of the electric field generated between the cathode of the side electron gun and the aperture in the first grid electrode opposite to the cathode is large at a small electron beam current and decreases as the current of electron beam increases.

As explained above, according to the present invention, a horizontally asymmetric electrode geometry is provided on the side electron beam apertures on the side facing the cathodes for the two side electron guns such that the degree of the horizontal asymmetry in a distribution of the electric field at a small electron beam current through the electron beam apertures is large and causes the electron beams to underconverge, but the degree of a horizontal asymmetry in a distribution of the electric field decreases in accordance with an increase in the electron beam current and causes the electron beams to overconverge and cancel the underconverging action to repulsion between the electron beams and achieve proper convergence over whole current region.

By doing this, the three electron beams impinge on the respective intended phosphors on the phosphor screen regardless of the amount of electron beam current and a satisfactory image is reproduced.

What is claimed is:

1. In a color cathode ray tube including an evacuated envelope comprising a faceplate portion, a neck portion and a funnel portion therebetween, a multi-apertured color selection electrode suspended in said evacuated envelope and disposed a short distance from a color phosphor screen formed on an inner surface of said faceplate portion, an inline electron gun housed in said neck portion for emitting and directing one center electron beam and two side electron beams so to converge on said color phosphor screen, and a deflection device mounted in the neighborhood of junction of said neck portion and said funnel portion of said evacuated envelope for generating a magnetic field for deflecting said three electron beams emitted from said electron gun in two horizontal and vertical directions, said electron gun having three cathodes arranged in an inline direction and a plurality of grid electrodes arranged along a tube axis toward said color phosphor screen from said three cathodes including a first grid electrode facing said three cathodes and an electrode geometry asymmetric in said inline direction being provided on two side beam apertures in said first grid electrode for said two side electron beams on a side facing said three cathodes.

2. A color cathode ray tube according to claim 1, wherein said electrode geometry asymmetric in said inline direction is provided by recesses superposed on said beam apertures and offset outwardly with respect to said side beam apertures.

3. A color cathode ray tube according to claim 2, wherein said asymmetric electrode geometry in said inline direction provided by said recesses superposed on said two side beam apertures and offset outwardly with respect to said two side beam apertures is arranged so that as a difference in voltage between said first grid electrode and one of said three cathodes associated with one of said two side electron beams increases, a degree of asymmetry in said inline direction in a direction of an electric field produced between said one of said three cathodes and said one of said two side beam apertures associated with said one of said three cathodes increases.

4. A color cathode ray tube according to claims 2, wherein a following inequality is satisfied:

$$0.3 < \frac{t}{T} < 0.9$$

where T is a thickness of said first grid electrode, and t is a thickness of a portion of said first grid electrode having said recesses.

5. A color cathode ray tube according to claim 2, wherein said side beam apertures are circular and said recesses are tangent to said side beam apertures at edges thereof on said center beam aperture side.

6. A color cathode ray tube according to claim 2, wherein said side electron beam apertures are circular and said recesses are rectangular with short sides thereof shorter than a diameter of said side beam apertures.

7. A color cathode ray tube according to claim 2, wherein said side beam apertures are circular and said recesses are rectangular with long sides thereof tangent to said side beam apertures.

8. A color cathode ray tube according to claim 7, wherein said recesses are rectangular and extending to edges of said first grid electrode.

9. A color cathode ray tube according to claim 7, wherein each of said recesses is rectangular with long sides thereof and a short side on a center beam aperture side thereof tangent to said side electron beam aperture.

10. A color cathode ray tube according to claim 9, wherein said recesses are rectangular and extending to edges of said first grid electrode.

11. A color cathode ray tube according to claim 1, wherein said side electron beam apertures are circular and said electrode geometry asymmetric in said inline direction is provided by a bank-shaped projection formed at edges of said side beam apertures on a side of said center beam aperture.

12. A color cathode ray tube according to claim 1, wherein said electrode geometry asymmetric in said inline direction is provided by recesses superposed on said beam apertures eccentrically with respect to said side beam apertures.

13. A color cathode ray tube according to claim 12, wherein a following inequality is satisfied $$0.3 < \frac{t}{T} < 0.9$$

where T is a thickness of said first grid electrode, and t is a thickness of a portion of said first grid electrode having said recesses.

14. A color cathode ray tube according to claim 12, wherein said side beam apertures are circular and said recesses are tangent to said side beam apertures at edges thereof on said center beam aperture side.

15. A color cathode ray tube according to claim 12, wherein said side electron beam apertures are circular and said recesses are rectangular with short sides thereof shorter than a diameter of said side beam apertures.

16. A color cathode ray tube according to claim 12, wherein said side beam apertures are circular and said recesses are rectangular with long sides thereof tangent to said side beam apertures.

17. A color cathode ray tube according to claim 16, wherein said recesses are rectangular and extending to edges of said first grid electrode.

18. A color cathode ray tube according to claim 16, wherein each of said recesses is rectangular with long sides thereof and a short side on a center beam aperture side thereof tangent to said side electron beam aperture.

19. A color cathode ray tube according to claim 18, wherein said recesses are rectangular and extending to edges of said first grid electrode.

20. A color cathode ray tube according to claim 1, wherein said asymmetric electrode geometry in said inline direction is provided on said two side beam apertures in said first grid electrode so that as a difference in voltage between said first grid electrode and one of said three cathodes associated with one of said two side electron beams increases, a degree of asymmetry in said inline direction in a direction of an electric field produced between said one of said three cathodes and said one of said two side beam apertures associated with said one of said three cathodes increases.

* * * * *